United States Patent [19]

Gibbons

[11] 4,325,273

[45] Apr. 20, 1982

[54] OPENER FOR SPLIT RING KEY HOLDER

[76] Inventor: James Gibbons, 205 W. Riverside Dr., Truth or Consequences, N. Mex. 87901

[21] Appl. No.: 158,806

[22] Filed: Jun. 12, 1980

[51] Int. Cl.[3] ..... A44B 15/00

[52] U.S. Cl. ..... 81/3 R; D3/64

[58] Field of Search ..... 81/3 R, 3 K; 254/104; 29/239, 253; D3/61, 62, 63, 64

[56] References Cited

U.S. PATENT DOCUMENTS 1,204,587 11/1916 Pfister ..... 81/3 R

*Primary Examiner*—Jimmy C. Peters

*Attorney, Agent, or Firm*—Cushman, Darby & Cushman

[57] ABSTRACT

A set of keys conventionally carried on a split ring key holder is augmented by a slot-headed wedging probe, having a heavier wedge end than head end, and having a slot length to overall length ratio that permits the probe to be rotated through the central opening of the split ring. When a key is to be slipped onto or off the split ring, the device is manipulated to insert the wedging probe between the split ring turns near the relevant end of the split. Thus the split is easily temporarily opened up and the key-slipping act is begun. Then the wedging probe device may be let loose from the user's grasp, whereupon it will naturally turn around and rejoin the set of keys still mounted on the ring.

14 Claims, 5 Drawing Figures

Fig. 1
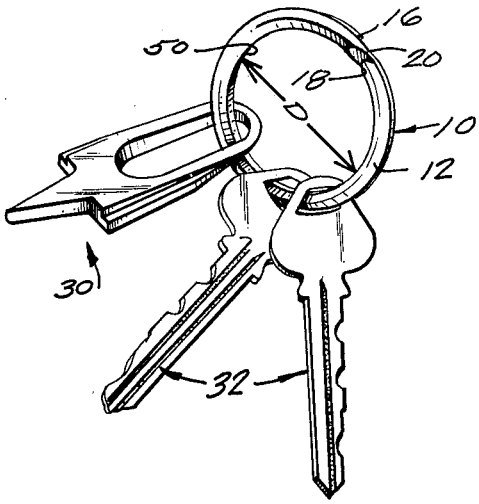
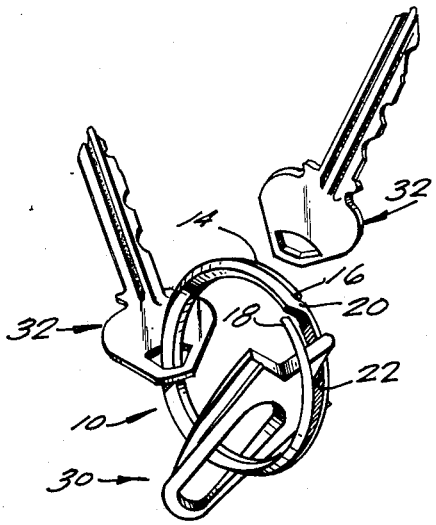
Fig. 2
Fig. 3
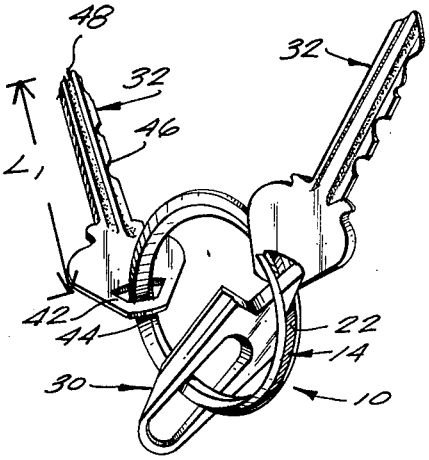
Fig. 4
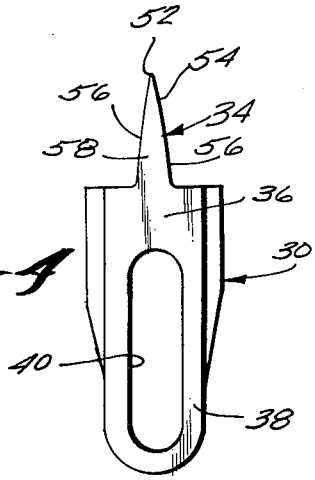
Fig. 5
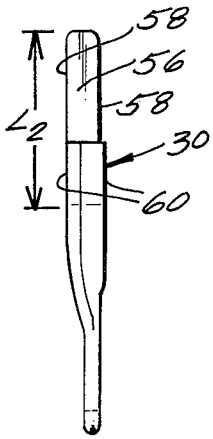

OPENER FOR SPLIT RING KEY HOLDER

BACKGROUND OF THE INVENTION

One of the simplist ways for carrying a set of lock keys, e.g. for opening Yale locks and other key-operated locks, is to thread the keys onto a split ring. For this and allied purposes, the typical key of this type has a hole in its handle portion which extends completely through the thickness of the key. Thus a set of keys may be kept together in a pocket or purse, or worn, e.g. on a belt loop. Sometimes non-key items are carried on the same split ring with a set of keys; e.g. a charm, a fingernail-clippers, a small screw driver and/or a relatively large decorative shield, tag, advertising sign or the like may be carried on the ring with the set of keys. The typical split ring is a tight spiral of brass, spring steel or equivalent synthetic plastic material, which extends through one complete helical turn, and a fraction of a second helical turn, e.g. from about one-tenth to about nine-tenths of a second helical turn.

Thus each end of the split ring lies axially adjacent an intermediate portion of the split ring and in order to thread a key onto the ring or off the ring it is necessary to temporarily, elastically force the respective split ring end axially away from the respective split ring intermediate portion. The typical split ring is approximately one and a quarter inches in diameter (although many sizes are used) and the typical key is approximately one and a half to three inches in length. Usually the hole in the handle portion of the typical key is about one-eighth inch from the rear end of the key and is circular, rounded-triangular or oval in shape, measuring about three-sixteenths inch across. Thus, when the typical key is mounted on the typical split ring key holder, the key blade is too long, and the hole in the key handle is too small, to permit rotation of the key through the central opening of the key ring.

There is a limit to the number of keys that can be carried on such a key ring; as more keys are slipped onto the ring it becomes increasingly more difficult to spread the split far enough apart to slip on one more key.

When slipping a key onto or off of a split ring key holder, the task of spreading the split axially open in order to start the slipping may be difficult, especially where the ring contains nearly a capacity complement of keys and the like and/or where the ring is made of especially stiffly resilient material and/or whether the user has less than average strength or dexterity in his or her hands and/or where the key to be slipped onto or off the ring is a thick one and/or the respective end of the key ring and the site on the key which must interact with it to open up the split gives little purchase.

A way that this latter problem has been addressed in the prior art is to provide a special site on the ring where the key to be mounted can be wedged into the split to open up the split. Typical solutions of this type are shown in the prior U.S. patents of Kirby, U.S. Pat. No. 932,787 issued Aug. 31, 1909, Korns, U.S. Pat. No. 1,462,205 issued July 17, 1932 and Becker, U.S. Pat. No. 603,247 issued May 3, 1898. Most of these prior art solutions are more effective when the user wants to slip a key onto the ring than when they want to slip a key off the ring. Furthermore, use of those inventions requires use of particular, somewhat unusually-shaped split rings that may not be widely available. The fact remains that most split ring key holders in use are plain and do not have built-in wedging provisions so there is a need to facilitate wedging open plain split key rings.

SUMMARY OF THE INVENTION

A set of keys conventionally carried on a split ring key holder is augmented by a slot-headed wedging probe, having a heavier wedge end than head end, and having a slot length to overall length ratio that permits the probe to be rotated through the central opening of the split ring. When a key is to be slipped onto or off the split ring, the device is manipulated to insert the wedging probe between the split ring turns near the relevant end of the split. Thus the split is easily temporarily opened up and the key-slipping act is begun. Then the wedging probe device may be let loose from the user's grasp, whereupon it will naturally turn around and rejoin the set of keys still mounted on the ring.

The principles of the invention will be further discussed with reference to the drawing wherein a preferred embodiment is shown. The specifics illustrated in the drawing is intended to exemplify, rather than limit, aspects of the invention as defined in the claims.

BRIEF DESCRIPTION OF THE DRAWING

FIG. 1 is a perspective view of a split ring key holder mounting a set of keys and an opener device of the present invention;

FIG. 2 is a perspective view of the structures of FIG. 1, showing how the opener device is used to spread the split for facilitating adding a key to the ring;

FIG. 3 is a perspective view of the structures of FIG. 1, showing how the opener device is used to spread the split for facilitating removing a key from the ring;

FIG. 4 is a front elevation view of the opener device; and

FIG. 5 is a side elevation view thereof.

DETAILED DESCRIPTION

In the drawings, item 10 is a plain, utterly conventional split ring key retainer, e.g. made of spring steel. The ring is constituted by a strip of metal which extends in a constant diameter helix 12 through one and a fraction of complete turns, for instance one and nine-tenths turns. The helix is maximally tight in an axial sense, so that the turns axially abut one another in the turn-overlapping "split" region 14 (being the entire region angularly between the two strip ends 16, 18 in which the helix 12 exists as multiple, axially adjoining turns).

Typically, some cross-sectional non-uniformity is intentionally provided in the helical strip 12 in order to make the ring 10 as a whole feel exteriorly rounded, yet axially compact. The way these objectives are shown being met in the example shown in the drawings is to make the strip have a D-shaped transverse cross-section within the overlapping, split region 14, and a circular transverse cross-section in an S-type transitional region 20 lying angularly outside the split region 14. The ring in the two angularly coextensive partial turns of the helix which together constitute the split have their D-shaped cross-sections axially oppositely oriented, so that the flat sides 22 of the two D-shapes are where the two partial turns abut. This is only one exempliary way; other conventional split ring key holders, e.g. have a constant flat-oval transverse cross-section throughout, or are of triangular cross-section where the key ring depicted in the drawings hereof is of D-shaped cross-section. In any event the sides 22 extensively abut and often are spring-loaded against one another, i.e. are resiliently pressed together providing a substantial force that must be overcome in order to part the split sufficiently to permit running an additional key onto the key or running an already mounted key off of the ring.

As is recognized in the prior patents referred to in the "Background" section hereinabove, the difficult part of putting a key on a split ring or taking it off is in accomplishing the initial step of opening the split; once the split is open and is being held that way by the material of the key as the key is being wound around the helix, the middle and end of the task are easily performed.

What the applicant has invented is a device 30 that can be carried on the ring 10 just like it is one of the keys 32, this device being sized and shaped to make the initial step of opening the split for adding or removing a key as simple and easy as the middle and end of the task.

The device 30 is shown by itself in FIGS. 4 and 5. In a very broad sense it is shaped like a key, in that it includes a tool bit 34 at the opposite end of a shank 36 from a handle 38 and in that the handle has an opening 40 through it in a thickness sense, by which the device 30 is itself carried on the ring 10 along with and among the keys 32.

While noting these similarities, it is important also to notice the differences.

On the usual key, the opening 42 is relatively small in diameter and located toward the far edge 44 of the key handle from the blade 46. The length $L_1$ along the usual key 32 from the opening 42 to the tip 48 of the blade 46, is greater than the internal diameter D of the helix of the split ring 10. Accordingly, if the ring is picked up between a finger and thumb, the keys 32 all tend to hang blade down even if the handle is broader than the blade, but the key cannot rotate through the central opening 50 of the ring 10.

In contrast, the device 30 of the invention has a relatively large opening 40 which is so elongated that it extends substantially all the way across the handle 38, and the shank 36 is so relatively short that the length $L_2$ along the shank from the opening 40 to the tip 52 of the tool bit 34 is less than the internal diameter D of the key ring 10.

The tool bit 34 comprises an axially forwardly projecting wedge 54 based on the shank. The wedge 54 has convergent opposite edge surfaces 56 which converge toward the tip 52. The opposite side faces 58 of the bit 34 are shown being generally parallel continuations of the corresponding opposite faces 60 of the shank. This provides a useful opening wedge without constituting a needle-like pocket hazard. The bit 34 is, by way of non-limiting example, one-eighth to three-sixteenths of an inch thick, about one-half inch long, and has a wedge angle between its edge surfaces 56 of about 15–20 degrees.

If a key 32 is to be added to the ring 10 on which the opener device 30 is mounted, the user moves the device 30 back enough to permit the point of the opening wedge to be brought within the central opening 50, and in the general plane of the ring 10. The point is aimed radially outwards at the split 14, near either one of the ends 16, 18, and jammingly pushed radially outwards thus parting the surfaces 22 and opening the near end of the split. The opening 42 of the key being added is then skewered onto the thus-separated end 16 or 18 and the key is begun to be wound around the helix 12 until it completely angularly traverses the split 14 and the split 14 snaps closed. Once the aforesaid key winding is begun, the task of the device 30 is completed and the user can simply let go of it. During the key winding, the wedge 54 will simply drop out of the split and the device 30 will naturally rotate so that it hangs down with the keys.

To remove a key 32 from the ring 10, the keys on the ring are arranged so that the one to be removed is located angularly just before one end of the split. Then the device 30 held on the ring 10 is pulled back, rotated around and jammed into the split near the relevant end, exactly as described above. Thus, the split is opened at the end nearest the key to be removed, by skewering its opening on the relevant end of 16 or 18 and beginning key winding. Once key winding has been initiated, the device 30 can be simply permitted to drop back with the remainder of the retained keys.

With a little thought, one can also see that the device 30 can be used to open-up the ring for its own installation on the ring or removal from the ring, provided some other prop is available to hold the split open once the wedge 54 has been used to open it.

The device 30 may be made of the same sorts of material that keys are made of.

Preferably there are shoulders 62 projecting laterally outwards from the shank 36 at the base of the wedge 54. These act, by abutting the ring from radially within the ring, as limiters of the extent to which the wedge 54 may be jammed into the split 14. Once the shoulders 62 are in contact with the ring, they help steady the ring 10/device 30 temporary combination, so that the user can, by pushing on the handle 38 end of the device 30, and on the outside of the ring 10 beside where the wedge is jammed into the split, easily hold the device in place as long as necessary. The relative breadth and flatness of the edges 56 also help make this task easier, as does the frictional contact of the edge surfaces 56 with the ring surfaces 22.

It should now be apparent that the opener for split ring key holder as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For facilitating installation of a key on and removal of the key from a split ring key retainer of the type comprising a tight helix of an internal diameter D of strip material which extends through at least one complete helical turn and at least a fraction of another, so as to have a portion intermediate two opposite ends of the strip, where corresponding portions of axially adjoining turns normally abut one another providing a normally closed split, an opener device, for temporarily opening up the split, near either end thereof so that a key already on the split ring can be begun to be wound off, or so that a key not yet on the ring can be begun to be wound onto the ring, said opener device comprising:

a shank having a handle at one end and a bit at the axially opposite end thereof;

said bit comprising an axially forwardly tapering wedging probe based on said shank, which wedging probe tapers to a tip;

said handle having means defining an axially elongated slot formed completely through the thickness thereof, and by which the opener device itself may be carried on the split ring key retainer just as if it were a key;

said slot being so long that the length L axially along the opener device from the slot to said wedging probe tip is less than said internal diameter D.

2. The opener device of claim 1, constituted by an integral piece of stiff, key-making material.

3. The opener device of claim 1, wherein said wedging probe is of generally rectangular transverse cross-sectional shape, having two opposed, generally parallel faces and two opposed converging edges.

4. The opener device of claim 3, wherein:

said wedging probe embodies an included angle of about 15–20 degrees between said converging edges.

5. The opener device of claim 1, wherein:

said handle, shank and bit are relatively sized and weighted so as to cause the opener device to hang tip downwards/handle upwards when freely suspended on the split ring key retainer.

6. The opener device of claim 1, further including:

means providing a penetration-limiting shoulder on said shank, protruding transversally at the base of said wedging probe for limiting the extent to which the wedging probe may be jammed into said split.

7. In combination with a split ring key retainer comprising a tight helix of an internal diameter D of strip material which extends through at least one complete helical turn and at least a fraction of another, so as to have a portion intermediate two opposite ends of the strip, where corresponding portions of axially adjoining turns normally abut one another providing a normally closed split, an opener device, for temporarily opening up the split, near either end thereof so that a key already on the split ring can be begun to be wound off, or so that a key not yet on the ring can be begun to be wound onto the ring, said opener device comprising:

a shank having a handle at one end and a bit at the axially opposite end thereof;

said bit comprising an axially forwardly tapering wedging probe based on said shank, which wedging probe tapers to a tip;

said handle having means defining an axially elongated slot formed completely through the thickness thereof, and by which the opener device itself may be carried on the split ring key retainer just as if it were a key;

said slot being so long that the length L axially along the opener device from the slot to said wedging probe tip is less than said internal diameter D.

8. The split key ring/opener device combination of claim 6, constituted by an integral piece of stiff, key-making material.

9. The split key ring/opener device combination of claim 6, wherein said wedging probe is of generally rectangular transverse cross-sectional shape, having two opposed, generally parallel faces and two opposed converging edges.

10. The split key ring/opener device combination of claim 9, wherein, said wedging probe embodies an included angle of about 15–20 degrees between said converging edges.

11. The split key ring/opener device combination of claim 6, wherein:

said handle, shank and bit are relatively sized and weighted so as to cause the opener device to hang tip downwards/handle upwards when freely suspended on the split ring key retainer.

12. The split key ring/opener device combination of claim 6, further including:

means providing a penetration-limiting shoulder on said shank, protruding transversally at the base of said wedging probe for limiting the extent to which the wedging probe may be jammed into said split.

13. A new use for a device which comprises:

a shank having a handle at one end and a bit at the axially opposite end thereof;

said bit comprising an axially forwardly tapering wedging probe based on said shank, which wedging probe tapers to a tip;

said handle having means defining an axially elongated slot formed completely through the thickness thereof, and by which the device itself may be carried on a centrally open split ring key retainer of the type comprising a tight helix of strip material which extends through at least one complete helical turn and at least a fraction of another, so as to have a portion intermediate two opposite ends of the strip where corresponding portions of axially adjoining turns normally abut one another providing a normally closed split just as if said device were a key, said new use comprising:

(a) selecting a split ring key retainer having an internal diameter which is larger than the length axially along the device from said slot thereof to said wedging probe tip thereof but which is smaller than the length axially along the device for said wedging probe tip to the furthest extent of said slot;

(b) slipping the device onto the split ring key retainer just as if it were a key and allowing it to hang down just as if it were a key;

(c) for adding a key to the split ring key retainer, (i) moving the device axially back sufficiently to permit the wedging probe tip within the central opening and into the general plane of the ring;

(ii) aiming the wedging probe tip radially outwards at said split;

(iii) jammingly pushing the device radially outwards thus forcing the wedging probe tip between said portions of the split and opening said split;

(iv) skewering a key onto an end of a respective one of said portions;

(v) winding the key around the helix of said split ring key retainer until it completely angularly traverses the split; and (vi) allowing the wedging probe tip to drop out of the split and the split to snap closed.

14. A new use for a device which device comprises:

a shank having a handle at one end and a bit at the axially opposite end thereof;

said bit comprising an axially forwardly tapering wedging probe based on said shank, which wedging probe tapers to a tip;

said handle having means defining an axially elongated slot formed completely through the thickness thereof, and by which the device itself may be carried on a centrally open split ring key retainer of the type comprising a tight helix of strip material which extends through at least one complete helical turn and at least a fraction of another, so as to have a portion intermediate two opposite ends of the strip where corresponding portions axially adjoining turns normally abut one another providing a normally closed split just as if said device were a key, said new use comprising:

(a) selecting a split ring key retainer having an internal diameter which is larger than the length axially along the device from said slot thereof to said wedging probe tip thereof but which is smaller than the length axially along the device from said wedging probe tip to the furthest extent of said slot;

(b) slipping the device onto the split ring key retainer just as if it were a key and allowing it to hang down just as if it were a key;

(c) for removing a key conventionally retained on the split ring key retainer, (i) winding the key around the helix of said split ring key retainer until it is disposed next to the split;

(ii) moving the device axially back sufficiently to permit the wedging probe tip within the central opening and into the general plane of the ring;

(iii) aiming the wedging probe tip radially outwards at said split;

(iv) jammingly pushing the device radially outwards thus forcing the wedging probe tip between said portions of the split and opening said split;

(v) winding the key on the respective ring portion out through the opened split, allowing the wedging probe tip to drop out of the split and the split to snap closed.

* * * * *